US005984757A

United States Patent [19]

Tsai

[11] Patent Number: 5,984,757

[45] Date of Patent: Nov. 16, 1999

[54] BATTERY OPERATED ARTICULATED FIGURE

[76] Inventor: Morgan S. Tsai, 4085 Merganser Dr., Fremont, Calif. 94555

[21] Appl. No.: 09/059,026

[22] Filed: Apr. 13, 1998

[51] Int. Cl.[6] ..... A63H 33/26; G09F 19/00

[52] U.S. Cl. ..... 446/129; 446/133; 446/322; 40/426; 335/219

[58] Field of Search ..... 446/129, 133, 446/322; 40/426; 368/165, 179; 335/219

[56] References Cited

U.S. PATENT DOCUMENTS

| | | | |
|---|---|---|---|
| 2,051,992 | 8/1936 | Frey . | |
| 3,584,454 | 6/1971 | Siefert . | |
| 3,835,561 | 9/1974 | Camerino . | |
| 4,544,282 | 10/1985 | Sanchez Giraldez | 368/179 |
| 4,613,236 | 9/1986 | Nakamura | 368/165 |
| 5,370,569 | 12/1994 | Mo-Hsin | 446/175 |
| 5,446,236 | 8/1995 | Nakada et al. | 84/102 |
| 5,890,947 | 4/1995 | Tanaka et al. | 446/298 |

*Primary Examiner*—Robert A. Hafer
*Assistant Examiner*—Laura Fossum
*Attorney, Agent, or Firm*—Linval B. Castle

[57] ABSTRACT

A wall mounted figure that has swinging legs and arms and a swaying head that continuously moves in dancing movements is constructed with two pendulums with permanent magnets influenced by electromagnetic fields generated by two current-carrying coils. The pendulums operate independently so that the legs and the head and arms swing at different rates to give an appearance of a person dancing the twist.

8 Claims, 1 Drawing Sheet

BATTERY OPERATED ARTICULATED FIGURE

BRIEF SUMMARY OF THE INVENTION

This invention relates to wall-mounted, battery operated figures and more particularly to a frame having two independent pendulums, one for motion of the lower part of the figure and one for movement of the upper part or the arms and head of the figure.

The figure may be that of an erect animal or the image of a person. The leg portion is coupled to one pendulum so that the leg portion sways back and forward at a slow rate of approximately sixty cycle per minute while the upper arms and head are coupled to a second pendulum and swing back and forward at some higher rate of perhaps ninety cycles per minute. Thus, depending upon the design of the clothing, the figure of a man may appear to be dancing the twist, or the figure of a girl may appear to be dancing the hula.

Each of the pendulums has, at its bottom end, a magnet which is repelled outward by the action of an electromagnetic field produced by an adjacent coil that is coupled to a small batter. The outwardly extended pendulum, weighted by the its attachments, such as arms, legs, the magnet and a weighted bob, then swings down by gravity where it is again repelled outward by the electromagnetic field. The action in each pendulum is identical. Only the lengths and periods of each of the pendulums are different.

BRIEF DESCRIPTION OF THE DRAWINGS

In the drawings which illustrate the preferred embodiment of the invention.

DETAILED DESCRIPTION OF THE PREFERRED EMBODIMENT

The invention is for a battery operated, wall mounted articulated figure and a double pendulum system connected to parts of the figure that make the figure appear to be continuously dancing. The figure may be of an erect animal or an image of a human. In the illustrated embodiment, the figure is a male appearing to be dancing the twist, with swinging legs coupled to one pendulum and the arms and head coupled to a second pendulum that has a different period of oscillation. The figure need not appear to be dancing. If desired, the swinging legs could be shown attached to a skier or surfer on a snowboard or a surfboard to represent the figure performing a slalom down a snow run or a wave front. Or the swinging hands may be holding a microphone to his mouth to represent a singer, or the arms may be upright to represent a basketball player catching a ball above his head.

Figure 1:
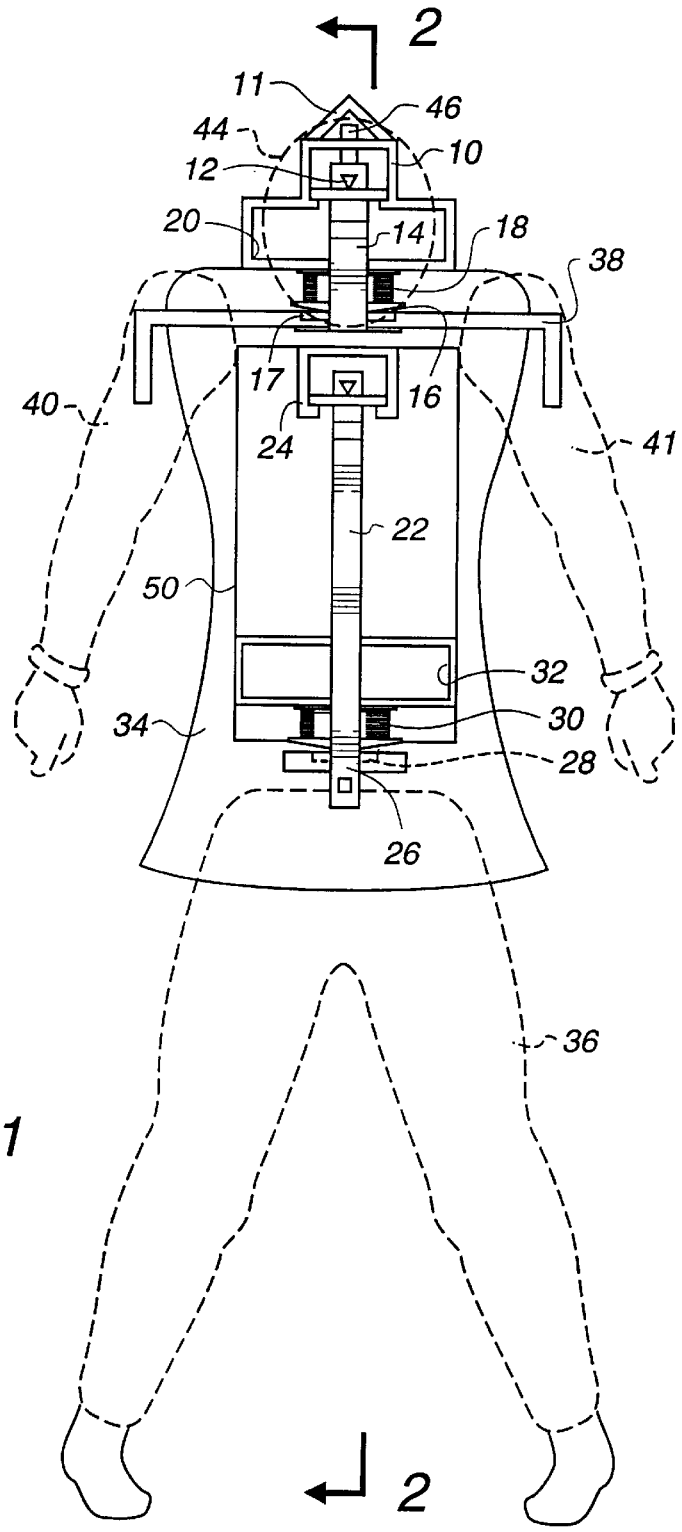
FIG. 1 is a front elevational view of the battery operated pendulum mechanism, with a dancing male figure shown by broken lines.
Figure 2:
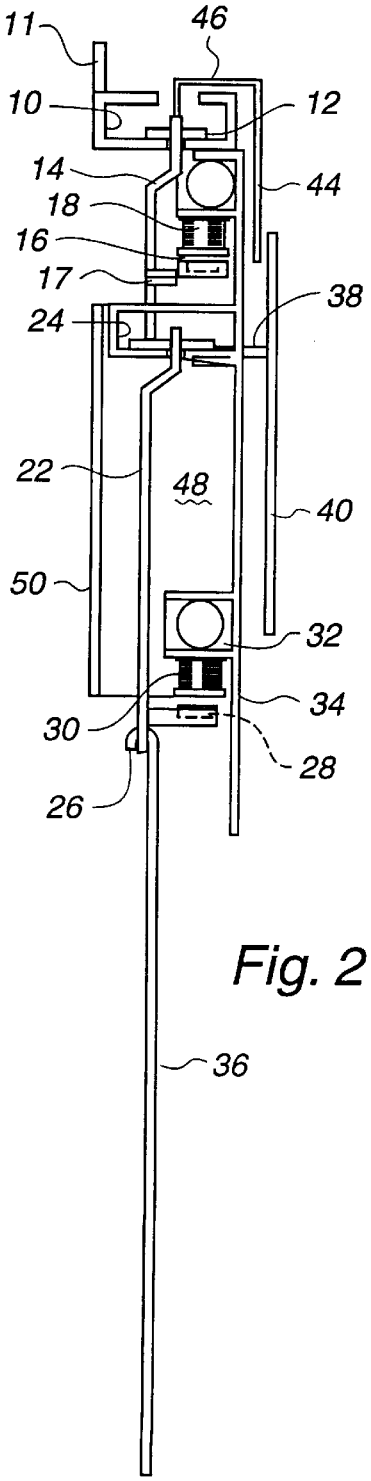
FIG. 2 is a side elevational view thereof taken along the lines 2—2 of FIG. 1.

FIGS. 1 and 2 illustrate a plastic housing 10 with wall hanger loop 11 and containing a pivot 12 for a short lightweight plastic pendulum 14 which has a comparatively heavy stabilizing bob 17 at the bottom. On the top surface of the bob 17 is a horizontal platform carrying a magnet 16, spaced about ¾ inch from the bob 17, and which is approximately ½ inch square and ¼ inch thick and magnetized with the poles at opposite ends as opposed to opposite surfaces.

Positioned above magnet 16 and aligned with the centerline of the pendulum 14, at rest, is a coil 18 comprised of approximately 5000 turns of No. 40 A.W.G. wire wrapped around a small ferromagnetic core. The spacing between the end of the core of coil 18 and the top surface of the magnet 16 is approximately ⅛ inch. The coil 18 draws a very small D.C. current from a 1.5 volt battery stored within a battery compartment 20 cemented to the bottom of housing 10 below the pivot 12.

When the coil 18 is initially energized by the battery, there may be a perceptible movement of the magnet 16 and the pendulum 14 caused by a reaction of the magnetic poles of the magnet to the electromagnetic field produced by the electric current through the coil 18. However, if manually started by swinging the pendulum 14 in either direction, it will continue to swing unaided for about a year, depending upon battery life.

The initial manual swing of the pendulum 14 has the effect of lifting the magnet 16 above its normal position so that gravitational force will return the magnet to its lowest position at the bottom of the pendulum swing. The inertia in this returning swing will carry the magnet past this point where the electromagnetic field of the coil 18 adds boost to the magnet and pendulum. Gravity again returns the magnet to the opposite end of the swing and back down again to where the electromagnetic field again influences by boosting the magnet and pendulum to a position of higher energy, ready to pass through another cycle.

A second pendulum 22, longer than the first and with a longer period of oscillation, is pivoted in a housing 24 immediately below the pendulum 14 and terminates with a connector 26 at its lower end. Near the lower end of the pendulum 22 is attached a magnet 28 driven by a coil 30, and 1.5 Volt battery in compartment 32 in a manner identical with that of the associated with the pendulum 14. The operation is also identical except that the period of oscillation will be longer because pendulum 22 is longer than pendulum 14. The only coupling between the two pendulums is a plastic back plate 34 to which the housing 20, 24 and 32 are cemented.

In the embodiment illustrated in FIG. 1 the figure is that of a male human dancing the twist. Therefore, a thin plastic sheet cut to form the desired stationary body 34 which, in FIG. 1 includes only a long jacket, without sleeves, as outlined in broken lines. The lower part of the jacked covers the pendulum 22 and its connector 26. A pair of separated legs 36 is formed from a thin sheet of plastic and provided with a hook for connecting the legs to the connector 26 on the lower end of the pendulum 22. The legs 36 will swing back and forth at a rate of about once a second to give the effect of dancing.

The legs 36 may be other that illustrated. For example, the pendulum 22 may be coupled to legs of a snowboarder or to a tightrope walker or a hula dancer. All will have different shaped legs that swing at the end of the pendulum 22.

The arms and the head are coupled to the pendulum 14. As best shown in FIG. 2, a plastic bar 38 is cemented between the pendulum 14 and bob 17 and extends laterally out about three inches from each side of the pendulum. At this point the bar 38 is shown turning downward about one inch, then turning at a right angle past the plastic back plate 34 to points of connection with the lightweight plastic arms 40, 41 of the figure which are parallel with the back plate 34 and separated therefrom approximately ¼ inch.

The downturning of bar 38 at a point about three inches from each side of pendulum 14 is proper for the particular figure illustrated. The bar 38 may gradually curve from the pendulum instead of extending in a straight line, as shown, or it may be turned upward, or not turned at all, in some figures. For example, a hula dancer or a dancing animal such as a bear may have arms turned upward.

In the embodiment illustrated the head 44 of the figure sways sideways and appears to roll with the movement of the arms 40, 41. A thin strip 46 of metal is attached to the top surface of the pendulum 14 and is bent over in to end front of the back plate 34 where it is cemented to the rear surface of a thin plastic sheet that is cut and printed to resemble the desired head of the figure. The head 44 is parallel with the plate 34 and because it lies between the arms 40, 41, it may be coplanar with the arms. If desired, other lightweight objects may be connected to the top of the pendulum 14. For example, if the figure were of a basketball player, a swinging ball could be placed above the head by cementing the ball to a thin strip of metal which runs vertically down to the top surface of the pendulum.

The back is preferably covered by a removable plastic cover 50 that extends from the top of the pivot housing 24, grasps the sides of the battery compartment 32, and has an exterior surface coplanar with the exterior surface of housing 10. The purpose for this cover plate 50 is to assure that the articulated figure is suspended flat against a wall and that the two pendulums are free to swing.

It should be noted that between the bottom of pivot housing 24 and the top battery compartment 32 there is a large empty unused space 48. This space 48 may be used for a miniature radio or a battery operated clock, if desired.

I claim:

1. A wall-mounted, articulated figure comprising:

a body having continuously moving head, arms, and legs coupled thereto;

a first pendulum carrying a permanent magnet deflected by an adjacent first electromagnetic field, said first pendulum coupled to the legs of the figure for swinging said legs;

a second pendulum coupled carrying a permanent magnet deflected by an adjacent second electromagnetic field, said second pendulum coupled to the arms and the head of the figure for swinging said arms and for swaying said head;

said first and said second pendulums having different periods of oscillation and are independent from each other; and a source of direct current for generating said first and said second electromagnetic fields.

2. The articulated figure claim in claim 1 wherein said body spaced first and second housings each containing a pivot for said first and second pendulums, respectively, and further including structural connecting means for interconnecting said housings.

3. The articulated figure claimed in claim 2 wherein said first and said second electromagnetic fields are generated by spaced identical coils coupled to said connecting means.

4. The articulated figure claimed in claim 2 wherein said second housing has a hanger loop for wall mounting said articulated figure.

5. The articulated figure claimed in claim 1 wherein said second pendulum has a top surface and wherein a thin plastic head defining said head of said body is coupled to sway with said second pendulum by a thin strip of material connected to said top surface and to a surface of said head.

6. The articulated figure claimed in claim 1 wherein said second pendulum has a weighted bob at its lower end and carries its permanent magnet in a plane at a right angle to said bob, and wherein a non-magnetic bar is attached between said bob and said pendulum, said bar extending laterally each side of said pendulum for supporting and swinging the arms of the articulated figure.

7. The articulated figure claimed in claim 6 wherein said permanent magnet is on a horizontal platform attached to said pendulum and above said bob.

8. The articulated figure claimed in claim 1 wherein said first pendulum swings on a pivot at its first end and has connecting means at its second end, and wherein the legs of said body have coupling means for attachment to said connecting means to enable said legs to swing with said first pendulum.

* * * * *